US007559160B2

(12) United States Patent
Kelly

(10) Patent No.: US 7,559,160 B2
(45) Date of Patent: Jul. 14, 2009

(54) STUDDED FOOTWEAR

(75) Inventor: Paul Andrew Kelly, Warwickshire (GB)

(73) Assignee: Trisport Limited, Gaithersburg, MD (US)

( * ) Notice: Subject to any disclaimer, the term of this patent is extended or adjusted under 35 U.S.C. 154(b) by 0 days.

(21) Appl. No.: 10/409,185

(22) Filed: Apr. 9, 2003

(65) Prior Publication Data

US 2003/0188458 A1 Oct. 9, 2003

Related U.S. Application Data

(60) Provisional application No. 60/393,655, filed on Jul. 5, 2002.

(30) Foreign Application Priority Data

Apr. 9, 2002 (GB) ..... 0208144.6

(51) Int. Cl.
*A43B 5/00* (2006.01)
*A43B 23/28* (2006.01)

(52) U.S. Cl. ..... 36/127; 36/59 C; 36/59 R; 36/134; D2/906; D2/957

(58) Field of Classification Search ..... 36/134, 36/114, 128, 59 C, 67 D, 67 A, 67 R, 7.7, 36/7.6, 59 A
See application file for complete search history.

(56) References Cited

U.S. PATENT DOCUMENTS

| | | | | |
|---|---|---|---|---|
| 3,918,181 | A | 11/1975 | Masanobu | |
| 4,375,728 | A | 3/1983 | Dassler | |
| 6,023,860 | A * | 2/2000 | McMullin | 36/127 |
| 6,161,315 | A * | 12/2000 | Dalton | 36/134 |
| 6,167,641 | B1 * | 1/2001 | McMullin | 36/127 |
| 6,289,611 | B1 * | 9/2001 | Patterson et al. | 36/59 C |
| 6,305,104 | B1 * | 10/2001 | McMullin | 36/127 |
| 6,463,682 | B1 * | 10/2002 | Carroll, Jr. | 36/134 |
| 6,675,505 | B2 * | 1/2004 | Terashima | 36/134 |
| 6,694,647 | B1 * | 2/2004 | Patterson et al. | 36/59 C |
| 6,705,027 | B1 * | 3/2004 | Campbell | 36/127 |
| 6,708,428 | B2 * | 3/2004 | Chen | 36/59 C |

FOREIGN PATENT DOCUMENTS

| | | |
|---|---|---|
| DE | 4417563 | 11/1995 |
| EP | 0282257 | 9/1988 |
| EP | 0922401 | 6/1999 |
| JP | 2000245505 | 9/2000 |
| WO | 91/15131 | 10/1991 |
| WO | WO 9836653 | 8/1998 |
| WO | 99/09851 | 3/1999 |
| WO | WO 9937175 | 7/1999 |
| WO | WO 0064294 | 11/2000 |
| WO | 01/54527 | 8/2001 |
| WO | 01/58300 | 8/2001 |
| WO | WO 0154528 | 8/2001 |
| WO | 02/39840 | 5/2002 |

* cited by examiner

*Primary Examiner*—Jila M Mohandesi
(74) *Attorney, Agent, or Firm*—Edell, Shapiro & Finnan, LLC

(57) ABSTRACT

An outsole for an article of studded footwear in which said outsole (1) includes receptacles (2) for specifically-oriented studs (5). The outsole (1) also includes traction elements (7) formed integrally with the outsole (1). The studs (5) and traction elements (7) being so constructed and arranged to interact in use of the footwear. The traction elements (7) are designed to complement the spike configuration of the stud (5).

16 Claims, 2 Drawing Sheets

STUDDED FOOTWEAR

This application claims priority under 35 U.S.C. §119 and/or 365 to GB 0208144.6 filed in Great Britain on April 9, 2002 the entire content of which is hereby incorporated by reference.

This application claims priority under 35 U.S.C. §119(e) to U.S. Provisional Application No. 60/393,655 filed on Jul. 5, 2002 the entire content of which is hereby incorporated by reference.

This invention relates to studded footwear such as sports shoes, for example football boots and golf shoes. The term "football" is intended to encompass all sports known as football, such as soccer, rugby and American and Australian football.

The studs are intended to provide traction, having a ground-engaging part of a type suited to the sport involved. Thus, studs for football tend to have relatively sharp ground-piercing spikes, while those for golf shoes currently have relatively soft and blunt ground-gripping spikes. The studs are detachably fastened to the sole of the article of footwear by a screw-threaded spigot on the stud engaging in a correspondingly threaded socket in a receptacle moulded in, or otherwise secured to the shoe sole. The screw thread may be single start or multi-start, and the stud and socket also incorporate a locking ratchet to prevent accidental unscrewing of the stud.

The studs provide most, if not all, of the traction for the footwear, and may be of different kinds, even for one sport. Thus, golf studs may have dynamic spikes which flex when pressure is applied to them, or static spikes, which do not flex. A dynamic spike may not always flex in the manner intended, depending on the surface or the way the pressure is applied.

Previously, rotational orientation of the studs relative to the shoe sole was not necessary, as most studs are circular or otherwise rotationally symmetrical. Their final orientation relative to the shoe sole is therefore not relevant.

However, in some sports where the forces on the studs are relatively high and of a particular type, such as lateral forces or forces due to rapid forward acceleration of the wearer of the shoe, studs which are specifically-oriented can be more effective. (The term "specifically-oriented stud" will be used to include studs which are non-rotationally symmetrical, or studs which are rotationally symmetrical, but whose orientation relative to the shoe sole is significant.) A specifically-oriented stud must be oriented very precisely relative to the shoe sole to ensure that it operates in the desired manner. Most known screw threads and locking ratchets are unable to provide this precise orientation. We have devised a system of ensuring the precise orientation of the stud relative to the receptacle. Orientation of the receptacle in the sole then provides the precise orientation of the stud relative to the sole.

According to the present invention, an outsole for an article of studded footwear includes receptacles for specifically-oriented studs and traction elements formed integrally with the outsole, the studs and traction elements being so constructed and arranged to interact in use of the footwear.

The ability to provide precise orientation of the stud relative to the outsole means that the outsole can be designed with traction elements that work with the studs to improve the overall traction of the outsole.

Thus, where the studs for golf shoes include dynamic spikes, the traction elements may be formed on one or both circumferential sides of at least one spike. The traction elements can then guide the spikes as they flex, and also act as static or dynamic traction elements, The traction elements may extend at any appropriate angle from the outsole. They may be V-shaped or triangular in profile.

The traction elements will be designed to complement the spike configuration of a stud, which depends on the positioning of the stud in the outsole and the forces on the outsole in use.

An embodiment of the invention is illustrated by way of example in the accompanying drawings, in which.

Figure 1:
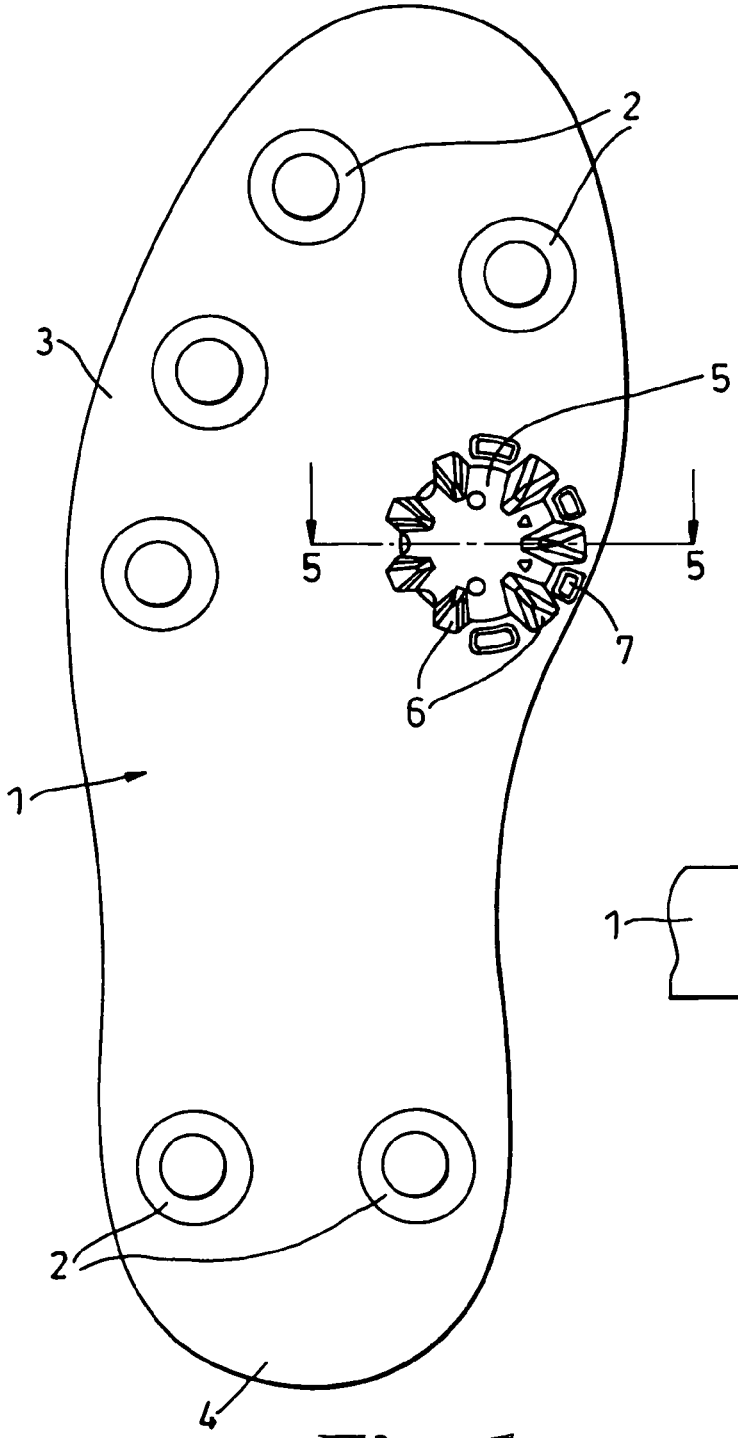
FIG. 1 is an underneath plan view of an outsole for a golf shoe with one stud attached.
Figure 2:
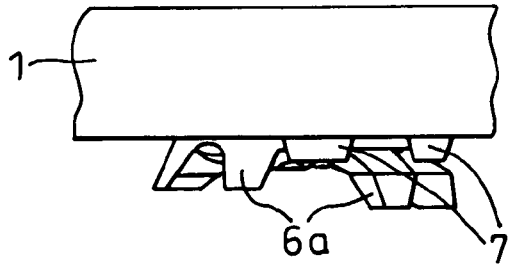
FIG. 2 is a side view of the stud of FIG. 1.
Figure 3:
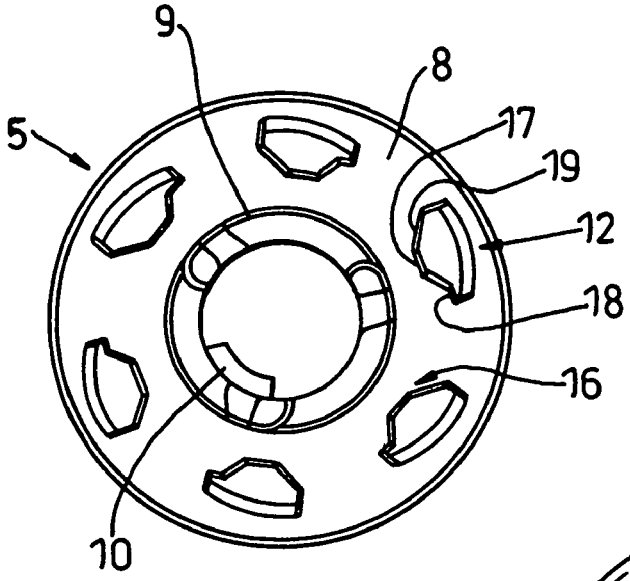
FIG. 3 is a top plan view of a stud.
Figure 4:
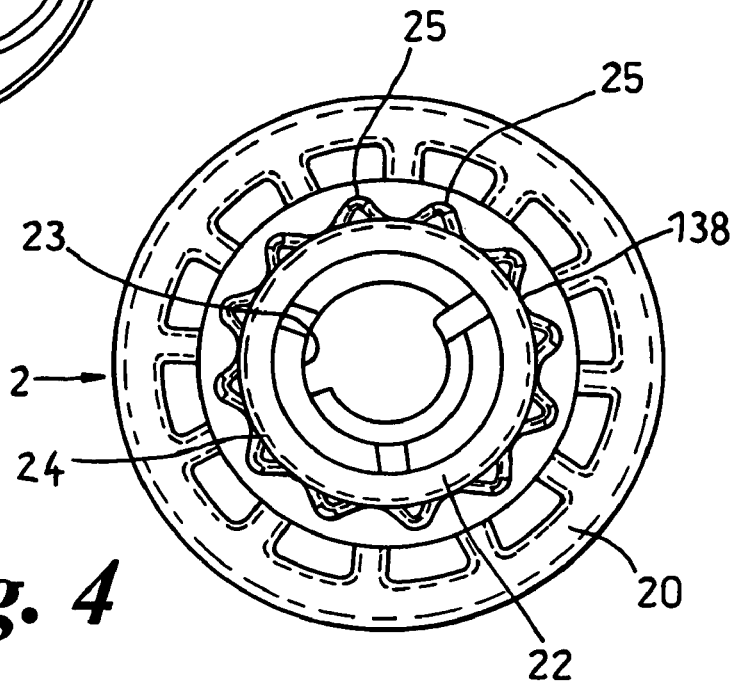
FIG. 4 is an underneath plan view of a receptacle.
Figure 5:
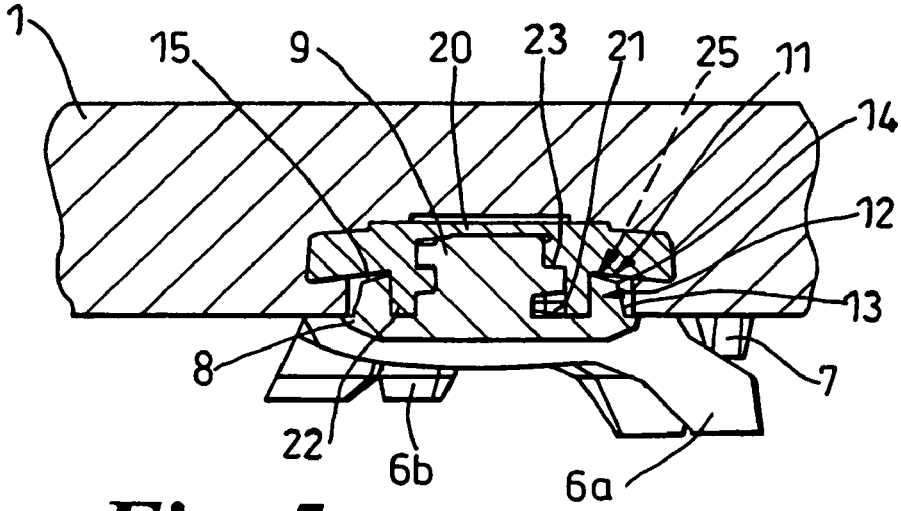
FIG. 5 is a scrap section along the line 5-5 of FIG. 1.

The outsole 1 of FIG. 1 is for a studded golf shoe. The outsole 1 is moulded from rubber, and incorporates several receptacles 2, which are moulded into the outsole 1 in the appropriate arrangement on the sole 3 and heel 4. Each receptacle 2 is adapted to receive a specifically-oriented stud 5 (only one of which is shown). The stud 5 has ground-engaging spikes 6 and the outsole 1 has integrally-formed traction elements 7, which in use interact with the spikes 6.

Each stud 5 is a unitary moulding of plastics material, having a flange 8 with a screw-threaded spigot 9 projecting from an tipper side of the flange 8, while the spikes 6 project from the lower side. There are three dynamic spikes 6*a*, which flex when pressure is applied to them, and five static spikes 6*b*, which do not.

The spigot 9 has a multi-start external screw thread 10, with a relatively steep helix angle so that the stud 5 can be inserted in the receptacle 2 in half a turn. In order to define the initial position of the stud 5 relative to the receptacle 2, one of the threads on the spigot 9 is different from the others so that the screw thread 10 can only be engaged in one position of the stud 5 relative to the receptacle 2.

Because of the relatively steep helix angle of the thread, the frictional resistance to unscrewing of the stud 5 is relatively low. The stud 5 and receptacle 2 therefore have a locking means 11, which comprises a ring of resilient posts 12 on the stud 5 co-operating with a ring of teeth 25 in the receptacle 2, arranged so that engagement of the teeth with the posts causes resilient deflection of the posts, and engagement of the teeth between the posts interengages the locking means. This serves to secure the stud 5 in the receptacle 2 and to define its final position relative to the receptacle 2. The stud 5 is then precisely oriented in the receptacle 2 when it is fully engaged.

The resilient posts 12 extend axially from the upper side of the flange 8. They surround the spigot 9 and form a ring concentric with the spigot 9. There are six posts 12 distributed uniformly about the axis of the stud. The axial extent of each post 12 is about half the axial height of the spigot 9, and each post is radially resilient. The radially outer surface of each post 12 has a lower part-cylindrical portion 13 and an upper part-conical portion 14. The top surface 15 of each post 12 is angled up towards the spigot 9, so that the radially inner surface 16 of each post 12 has the greatest axial height. The radially inner surface 16 is generally convex towards the spigot 9, with a central convex region 17, a first circumferential end 18 having a concave profile towards the spigot 9, and a second circumferential end 19 having a convex profile towards the spigot 9. The first end 18 is the leading end and the second end 19 the trailing end on insertion of the stud 5, and vice versa when it is removed. The concave profile of the first end 18 presents less resistance on insertion of the stud, while the convex profile of the second end 19 presents greater resistance on removal.

The receptacle 2 is also a unitary moulding of plastics material. It has a circular top plate 20 with a central boss 21 depending from it. The receptacle 2 is anchored in the outsole 1 by the top plate 20, which may include means (not shown) for ensuring that the receptacle 2 is precisely oriented relative to the outsole 1.

The boss 21 has a stout cylindrical wall 22, whose inside forms an internally screw-threaded socket 23 adapted to receive the spigot 9. The socket 23 also has a multi-start thread, with one of the grooves being different from the others, to complement the different thread 10 in the spigot 9, The radially outer surface 24 of the boss 21 is formed with the other part of the locking means 11, as the ring of axially-extending teeth 25, projecting radially outwards from the surface 24. In cross-section, the teeth 25 are generally triangular, but with a rounded apex.

The distance of radial projection of the teeth 25 from the socket axis is substantially equal to that of the inner surfaces of the posts 12 at the first end 19. There is therefore radial interference between the teeth 25 and posts 12, which causes frictional resistance to relative rotation of the stud 5 and receptacle 2.

The stud 5 is installed by the insertion of the spigot 9 into the socket 23. Because of the different thread 10 and groove, there is only one position in which the screw-threaded connection can engage. As the spigot 9 is rotated it is drawn into the socket 23, and the teeth 25 engage with the posts 12. The posts 12 deflect radially in a resilient manner to allow the teeth 25 to move past the posts 12. Once the spigot 9 has rotated through 180°, the stud 5 is fully inserted in the receptacle 2, and is secured by the interengagement of the teeth 25 and posts 12.

Thus, the position of the stud 5 in the receptacle 2 is precisely determined by the screw thread and the locking means 11. As the position of the receptacle 2 relative to the outsole 1 is also precisely determined, the spikes 6*a*, 6*b* of the stud 5 will be in a precisely determined position relative to the outsole 1, so that in use they can interact with the traction elements 7 on the outsole 1.

As shown in the Figures, four traction elements 7 are provided, so that there is one on each circumferential side of each dynamic spike 6*a*. Each traction element 7 is of substantially triangular form and projects from the outsole 1. The axial height of each traction element 7 is less than the axial extent of the dynamic spikes 6*a*. The elements 7 shown project substantially at right angles to the outsole 1, but may be at any suitable angle.

In use, when the shoe is worn, the weight of the wearer in the shoe causes the dynamic spikes 6*a* to flex radially outwards. Their movement is guided by the traction elements 7, which then also come into engagement with the ground to provide extra traction, as static spikes.

It will be appreciated that the construction and arrangement of the traction elements 7 will be designed to complement the studs 5 which are used. The traction elements 7 may therefore have different forms, and act dynamically or statically. It will also be appreciated that different thread forms and locking means may be used on the stud and receptacle, as required.

The invention claimed is:

1. An outsole for a shoe, the outsole comprising:

an outsole including a ground-engaging surface;

a receptacle formed into the outsole;

a first traction element adjacent a second traction element, the traction elements disposed at a radially spaced position from the receptacle, wherein:

the first traction element is oriented in spaced relation from the second traction element to define a space between the first traction element and the second traction element, the traction elements project distally from the ground-engaging surface of the outsole, and the traction elements are static elements configured not to flex upon the application of the weight of the wearer of the shoe;

a stud configured to couple to the receptacle in a predetermined orientation;

a static spike extending from the stud that does not flex when the weight of the wearer of the shoe is applied thereto; and a dynamic spike extending from the stud, wherein the dynamic spike flexes radially outward from the stud when the weight of the wearer of the shoe is applied thereto, and wherein the dynamic spike extends at least as far as the radially spaced position of the traction elements, wherein the predetermined orientation of the stud aligns the dynamic spike with the space defined between the first traction element and the second traction element such that, during flexure, the traction elements guide the dynamic spike through the space defined by the first and second traction elements and the dynamic spike is positioned between the traction elements.

2. The shoe outsole according to claim 1, wherein:

the dynamic spike includes proximal end, a distal end, a first circumferential side, and a second circumferential side;

the first traction element is disposed on the first circumferential side of the dynamic spike during flexure; and the second traction element is disposed on the second circumferential side of the dynamic spike during flexure.

3. The shoe outsole according to claim 1, wherein:

the outsole comprises a plurality of traction elements positioned at the radially spaced position from the receptacle, the plurality of traction elements defining a plurality of spaces between adjacent traction elements, each space being configured to receive and guide the flexure of a dynamic spike; and the stud comprises a plurality of dynamic spikes, wherein each of the dynamic spikes is aligned with one of the plurality of spaces such that each dynamic spike disposed on the stud is, during flexure, guided through a respective space by adjacent traction elements.

4. The shoe outsole according to claim 3, wherein the plurality of traction elements are formed on one circumferential side of the receptacle.

5. The shoe outsole according to claim 1, wherein the dynamic spike is maintained within the space defined between the first and second traction elements as the dynamic spike flexes radially outward.

6. The shoe outsole according to claim 1, wherein an axial height of each traction element is less than an axial extent of the dynamic spike.

7. The shoe outsole according to claim 3, wherein the stud further comprises a plurality of static spikes extending distally from the stud, wherein the plurality of static spikes do not flex when the weight of the wearer of the shoe is applied thereto.

8. A cleat system for an athletic shoe to be worn by a wearer, the cleat system comprising:

an outsole including:

a ground-engaging surface;

a receptacle operable to receive a stud formed into the outsole, the receptacle having a circumference;

a pair of traction elements spaced within a radial distance of the receptacle, the traction elements protruding from the ground-engaging surface, wherein the pair of traction elements includes first traction element oriented in spaced relation from the second traction element to define a space between the first traction element and the second traction element; and a stud including:

a flange, and a dynamic spike extending angularly from flange, the dynamic spike including a proximal end, a distal end, a first circumferential side, and a second circumferential side, wherein the dynamic spike is configured to flex radially outward toward the traction elements upon the application of the weight of the wearer, wherein the stud connects to the receptacle in a predetermined orientation to align the dynamic spike with the space defined between the first traction element and the second traction element, wherein the dynamic spike flexes radially outward along the ground engaging surface to extend into the space defined by the pair of traction elements such that the first traction element is disposed on the first circumferential side of the dynamic spike and the second traction element is disposed along the second circumferential side of the dynamic spike, and wherein the movement of the dynamic spike is guided through the space by the traction elements, and wherein the stud further includes a static spike extending distally from the flange, wherein the static spike is configured not to flex upon application of the weight by the wearer of the shoe.

9. The cleat system of claim 8, wherein the traction elements are static elements that do not flex when the weight of the wearer is applied.

10. The cleat system of claim 8, wherein:

the receptacle comprises a threaded socket;

the flange comprises an upper surface an a lower surface;

the dynamic spike extends distally from the lower surface; and the stud further includes a threaded member extending distally from the upper flange surface, wherein the threaded member is adapted to threadingly engage the socket to orient the dynamic spike in the predetermined position.

11. The cleat system of claim 8, wherein the traction elements are substantially perpendicular to the ground-engaging surface of the outsole.

12. The cleat system of claim 8, wherein:

the stud comprises a plurality of dynamic spikes extending angularly from the flange; and the outsole comprises a plurality of traction elements disposed proximate the receptacle to define a plurality of spaces, each space operable to receive and interact with one of the plurality of dynamic spikes.

13. The cleat system of claim 12, wherein the plurality of traction elements are oriented in an array along and spaced from the circumference of the receptacle.

14. The cleat system of claim 12, wherein:

the studded shoe outsole is coupled to a shoe worn by a wearer; and the plurality of dynamic spikes extends downward and outward from the flange under no load conditions and resiliently flex outward relative to the flange under load from the weight of a wearer of the shoe.

15. The cleat system of claim 12, wherein the traction elements:

are positioned at a radially spaced position from the receptacle such that the traction elements are positioned interspersed with and on opposite circumferential sides of respective dynamic spikes when the dynamic spikes are flexed under load; and physically guide the dynamic spikes as they flex.

16. The cleat system of claim 8, wherein the traction elements are positioned within the radial distance from respective studs and sufficiently proximate at least one of said dynamic spikes to guide said at least one spike as it flexes under load.

* * * * *

UNITED STATES PATENT AND TRADEMARK OFFICE

CERTIFICATE OF CORRECTION

PATENT NO. : 7,559,160 B2
APPLICATION NO. : 10/409185
DATED : July 14, 2009
INVENTOR(S) : Paul Andrew Kelly It is certified that error appears in the above-identified patent and that said Letters Patent is hereby corrected as shown below:

Column 2, line 25, replace “an tipper side” with -- an upper side --.

Signed and Sealed this

Twenty-seventh Day of October, 2009

David J. Kappos

David J. Kappos
*Director of the United States Patent and Trademark Office*